US007290910B1

(12) United States Patent
Hohl-AbiChedid et al.

(10) Patent No.: US 7,290,910 B1
(45) Date of Patent: Nov. 6, 2007

(54) S8 AFTER-MARKET LED SYSTEM

(75) Inventors: Angela Hohl-AbiChedid, Beverly, MA (US); Miguel Galvez, Danvers, MA (US); Thomas Tessnow, Weare, NH (US); Charles M. Coushaine, Rindge, NH (US); Robert H. Colburn, Groveland, MA (US)

(73) Assignee: Osram Sylvania Inc, Danvers, MA (US)

( * ) Notice: Subject to any disclaimer, the term of this patent is extended or adjusted under 35 U.S.C. 154(b) by 61 days.

(21) Appl. No.: 11/429,688

(22) Filed: May 8, 2006

(51) Int. Cl.
*F21V 7/04* (2006.01)

(52) U.S. Cl. ..... 362/541; 362/543; 362/545; 362/549

(58) Field of Classification Search ..... 362/541, 362/543, 545, 549, 800
See application file for complete search history.

(56) References Cited

U.S. PATENT DOCUMENTS

2002/0097586 A1* 7/2002 Horowitz ..... 362/545

* cited by examiner

*Primary Examiner*—Sandra O'Shea
*Assistant Examiner*—Mark Tsidulko
(74) *Attorney, Agent, or Firm*—William E. Meyer

(57) ABSTRACT

A light source system is arranged about an axis, and includes a planar member having top and bottom surfaces with a central aperture and a plurality of electrical conductors spaced about the central aperture and extending beyond the top and bottom surfaces. A portion of the electrical conductors extending beyond the top surface have electrical insulators. A base having passages to receive the electrical conductors extends beyond the bottom surface and includes a boss on the top surface fitted through the aperture. A body has a first part coaxial with the axis and a second part transverse to the axis. A light source is positioned near an end of the first part. The base is positioned at an opposite end of the body and a plurality of rod-like members project from the second part parallel to the axis; and a light emitting diode is positioned adjacent the first part.

7 Claims, 11 Drawing Sheets

S8 AFTER-MARKET LED SYSTEM

TECHNICAL FIELD

This invention relates generally to lamps and more particularly to signaling lamps. Still more particularly it relates to a light emitting diode (LED) replacement lamp for an automotive turn signal/stop lamp.

BACKGROUND ART

In the past, most automotive light sources have involved the use of incandescent bulbs. While working well and being inexpensive, these bulbs have a relatively short life and, of course, the thin filament employed was always subject to breakage due to vibration.

Recently some of the uses, particularly the high mount stoplight known as a CHMSL (center high mount stop light), have been replaced by LEDs. These solid-state light sources have incredible life times, in the area of 100,000 hours, and are not as subject to vibration failures. However, these LED sources have been hard-wired into their appropriate location, which increases the cost of installation. It would therefore be an advance in the art if an LED light source could be provided that had the ease of installation of the incandescent light sources. It would be a still further advance in the art if an LED light source could be provided that achieved an industry accepted interchangeable standard to replace the aforementioned incandescent bulb. It would be a still further advance if such an LED lamp could be provided as a replacement for the dual filament turn signal/stop light commonly used. Newer versions of these latter lamps often employ what is know in the industry as an S8 wedge base (as opposed to the older screw base or bayonet base) that plugs into a standard socket.

Further, as is the case with all LED light sources, when driven to their maximum potential a good deal of heat sinking is necessary. Therefore, it would be a still further advance if a suitable heat sink be provided within the relatively small volume that the previous incandescent lamp occupied.

DISCLOSURE OF INVENTION

It is, therefore, an object of the invention to obviate the disadvantages of the prior art.

It is a further object of the invention to enhance automotive signaling lights.

These objects are accomplished, in one aspect of the invention by a light source system arranged about an axis, the light source system comprising: a planar member having a top surface and a bottom surface with a central aperture therethrough and a plurality of electrical conductors spaced about the central aperture and extending beyond the top and bottom surfaces, at least a portion of the electrical conductors extending beyond the top surface having an electrical insulator thereon; a base having passages therethrough to receive the electrical conductors extending beyond the bottom surface and including a boss on the top surface fitted through the central aperture; a body having a first part coaxial with the axis and a second part transverse to the axis; at least one light source positioned near an end of the first part; the base being positioned at an opposite end of the body; a plurality of rod-like members projecting from the second part parallel to the axis; and at least one light emitting diode positioned adjacent the first part of the body.

This structure is very compact and occupies approximately the same volume as the incandescent bulb it replaces. The extending rod-like members provide excellent heat sinking and the base conforms to the standard S8 wedge socket. The light source system is rugged and easy to assemble.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 9:
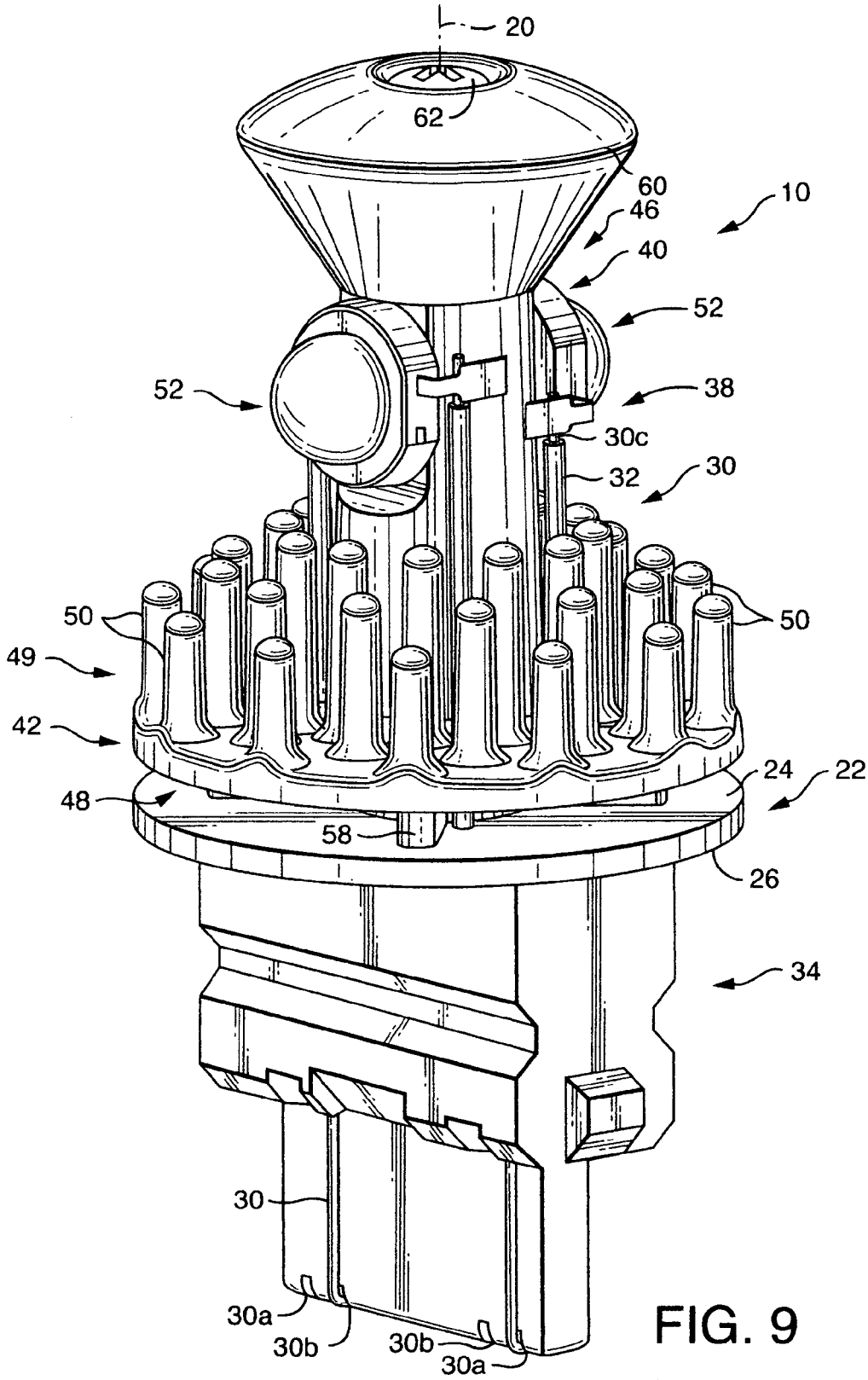
FIG. 9 is a perspective view of a completed light source.
Figure 10:
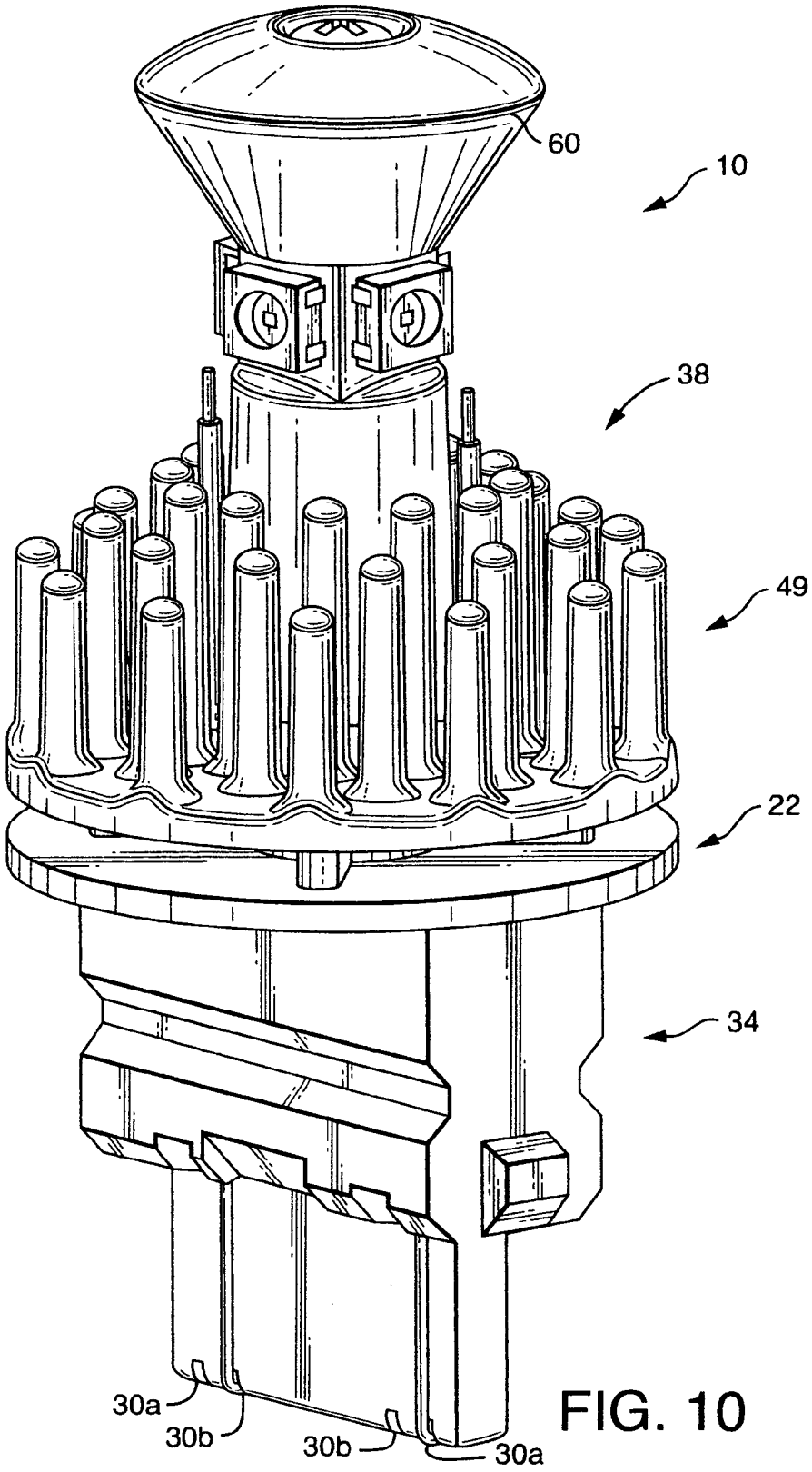
FIG. 10 is a perspective view of an alternate embodiment.

Referring now to the drawings with greater particularity, there is shown in FIG. 9 a light source system 10 arranged about an axis 20. The light source system 10 comprises a planar member 22 in the form of a printed circuit board that contains the electronic driver circuitry for the system, of a suitable material, e.g., copper, aluminum, zinc, magnesium or a thermally conductive plastic, having a top surface 24 and a bottom surface 26 with a central aperture 28 therethrough and a plurality of electrical conductors 30 spaced about the central aperture 28 and extending beyond the top and bottom surfaces. At least a portion of the electrical conductors extending beyond the top surface 24 have an electrical insulator 32 thereon.

A base 34 formed of a suitable electrically insulating material, e.g., nylon, has passages 36 therethrough to receive the electrical conductors 30 extending beyond the bottom surface 26. The electrical conductors 30 are bent around the bottom of the base via the grooves 34*a* and 34*b* to provide the electrical contact with the appropriate conductors in the receiving socket, which is not shown. A boss 37 is provided on the top surface 37*a* of the base 34 and is fitted through the central aperture 28. Preferably the boss 37 is provided with a key 56 that engages a keyway 54 formed with the aperture 28, A body 38 of a suitable heat conductive material, such as, e.g., copper, aluminum, magnesium, zinc or a thermally conductive plastic, has a first part 40 coaxial with the axis 20 and a second part 42 transverse to the axis 20. At least one light emitting diode 52 (preferably, two, oppositely disposed) is positioned adjacent the first part 40 of the body 38 and is appropriately fixed thereto and electrically connected to the terminal ends 30*c* of the electrical conductors 30.

The base 34 is positioned at an opposite end 48 of the body 38. The heat conduction away from the body 38 is enhanced by heat dissipaters 49 that can take the form of a plurality of rod-like members 50 that project away from the second part 42 parallel to the axis 20. The rod-like members 50 have varying lengths, with the longest being adjacent the body 38 and diminishing in height away from the body 38.

Figure 6:
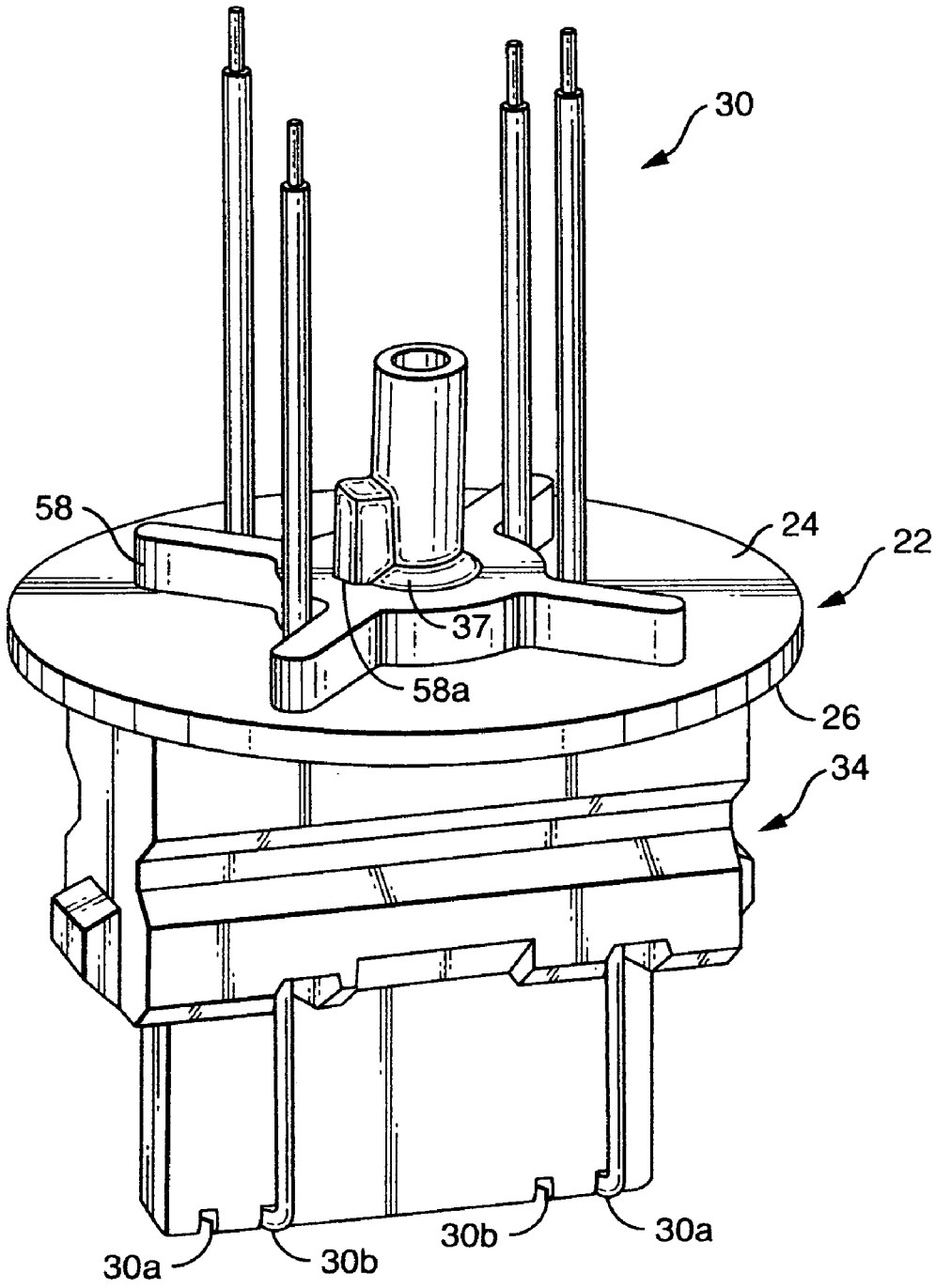
FIG. 6 is a perspective view of a spacer in position on the component.
Figure 7:
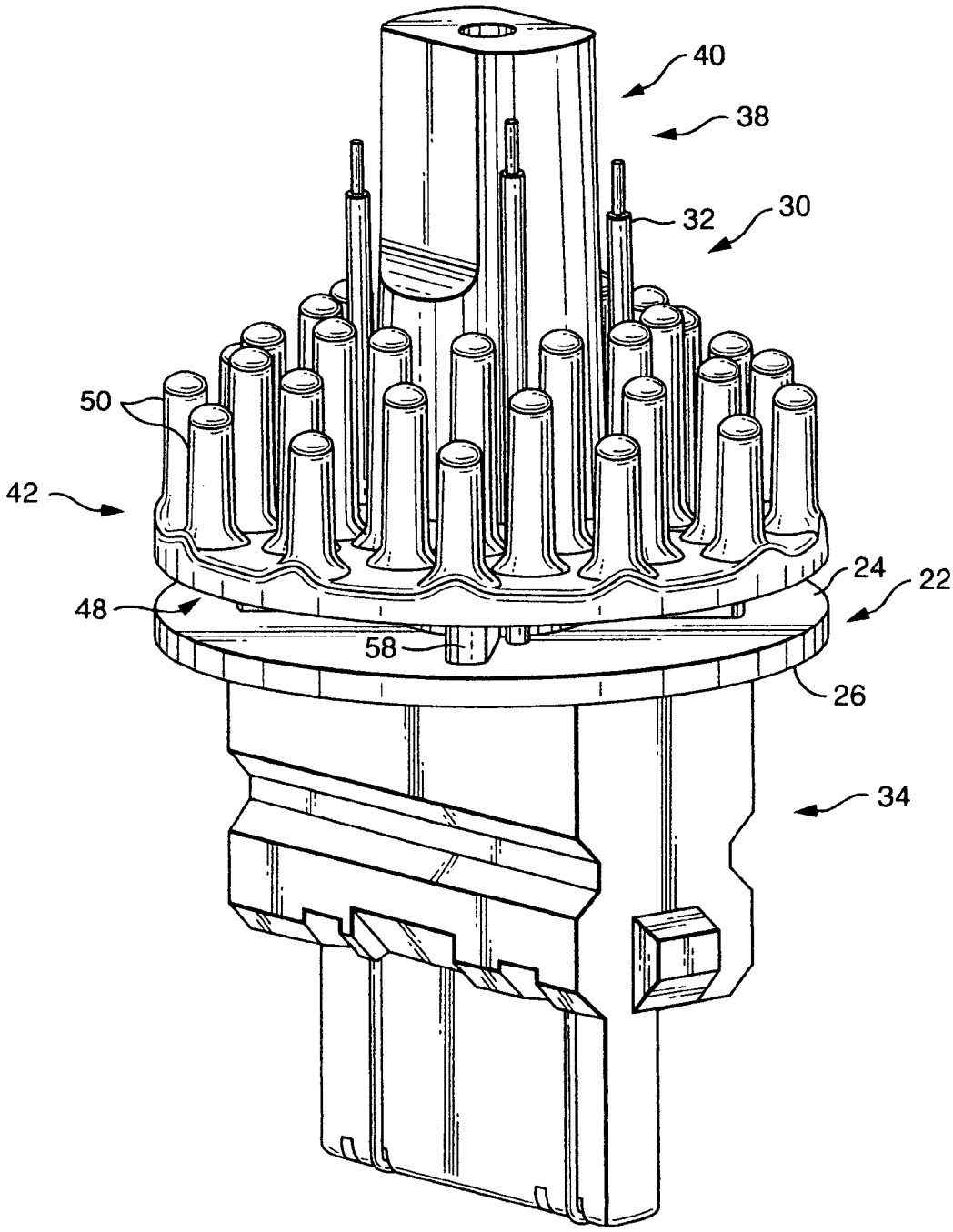
FIG. 7 is a perspective view of a body assembled upon the spacer.
Figure 8:
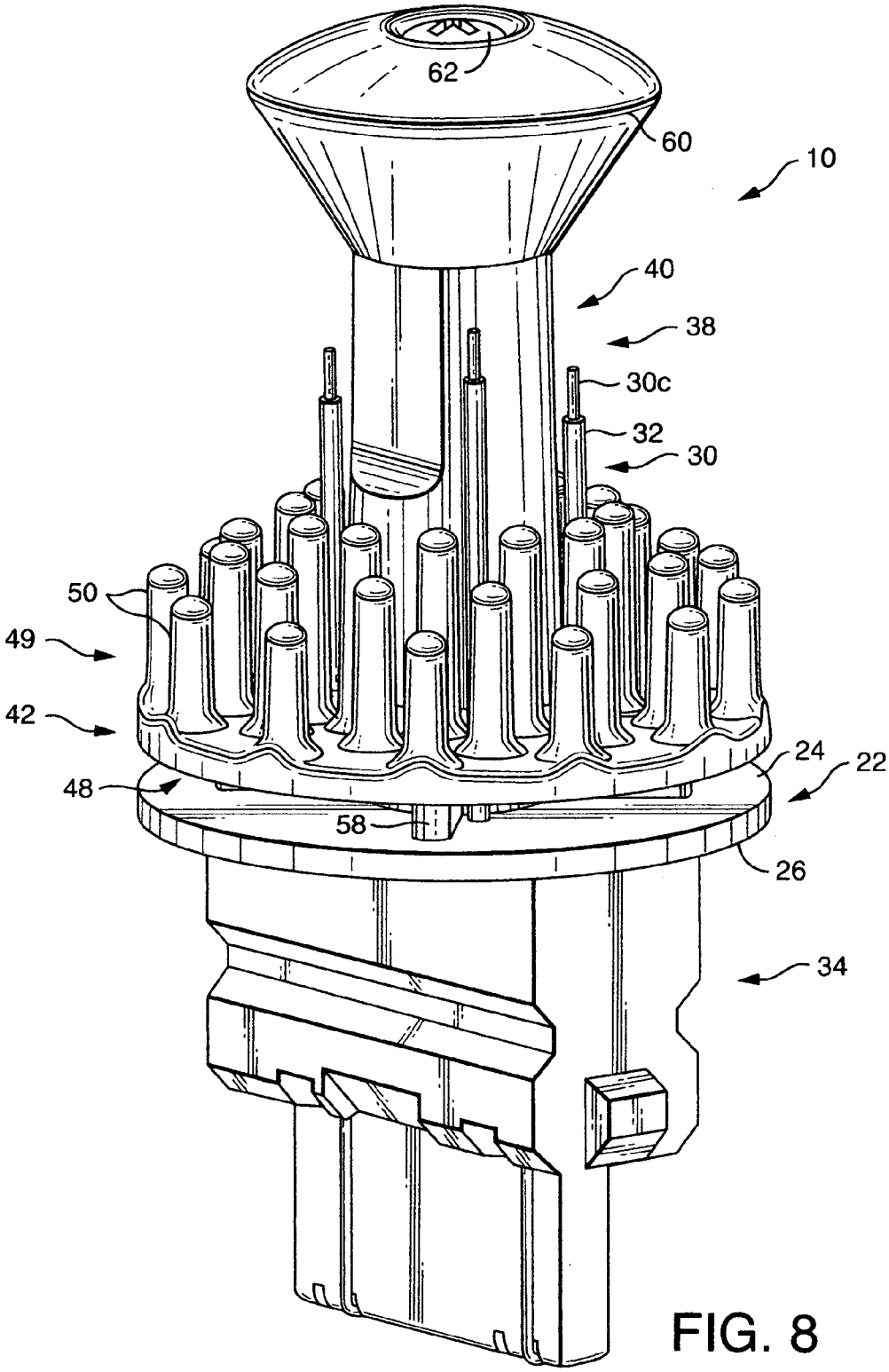
FIG. 8 is a perspective view of the summit assembled upon the body.

A spacer 58 (shown more clearly in FIG. 6) is provided between the second part 42 and the top surface 24 of the planar member 22 and achieves the dual function of providing an air gap between the body and the planar member and helping to duplicate the height of the formerly used incandescent lamp. The spacer 58 is preferably constructed of nylon and preferably is cruciform.

The first part 40 of the body 38 has a summit 60 formed as an inverted cone to aid in the handling of light source and in placing it in an appropriate socket. Additionally, the conical side of the inverted cone 60 can be plated with a reflective material if desired.

Figure 1:
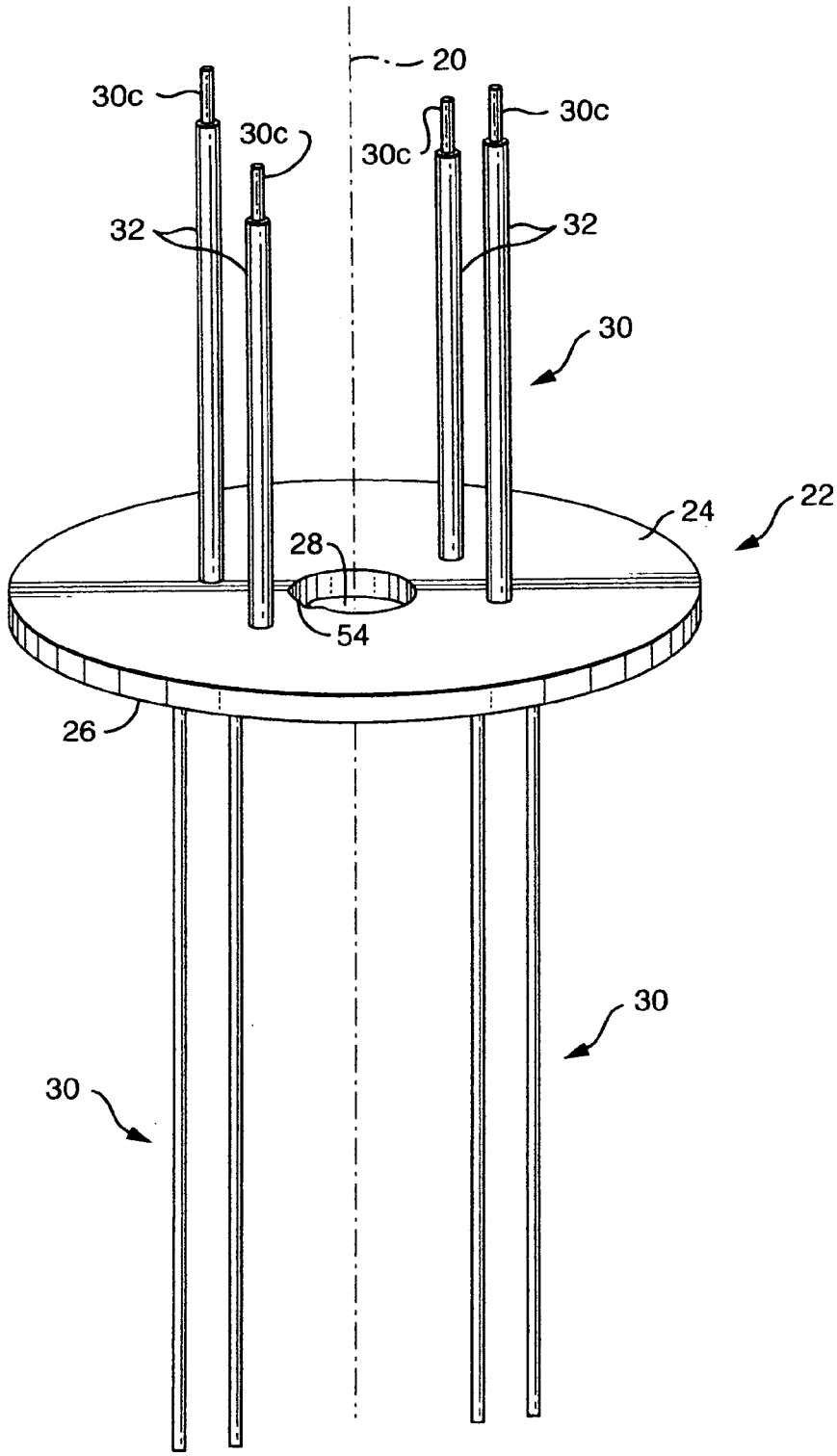
FIG. 1 is a perspective view of a component of the invention.
Figure 2:
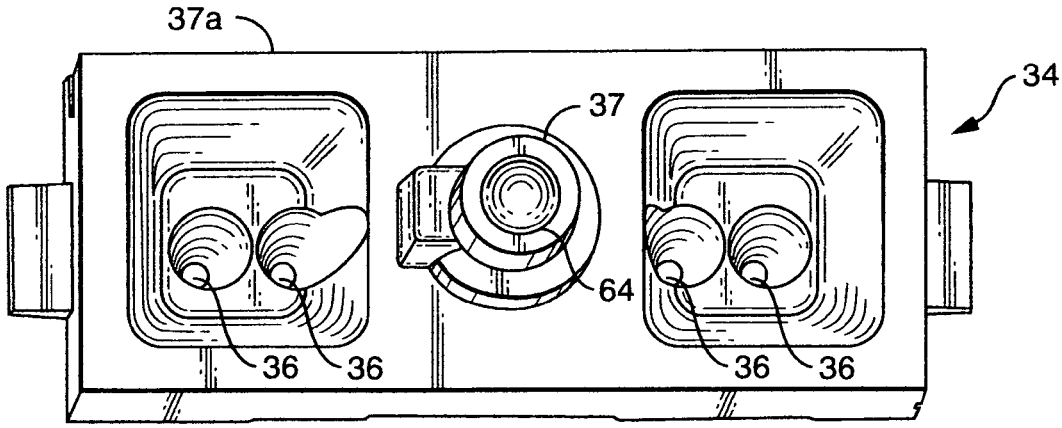
FIG. 2 is plan view of the top of a base utilized with the invention.
Figure 3:
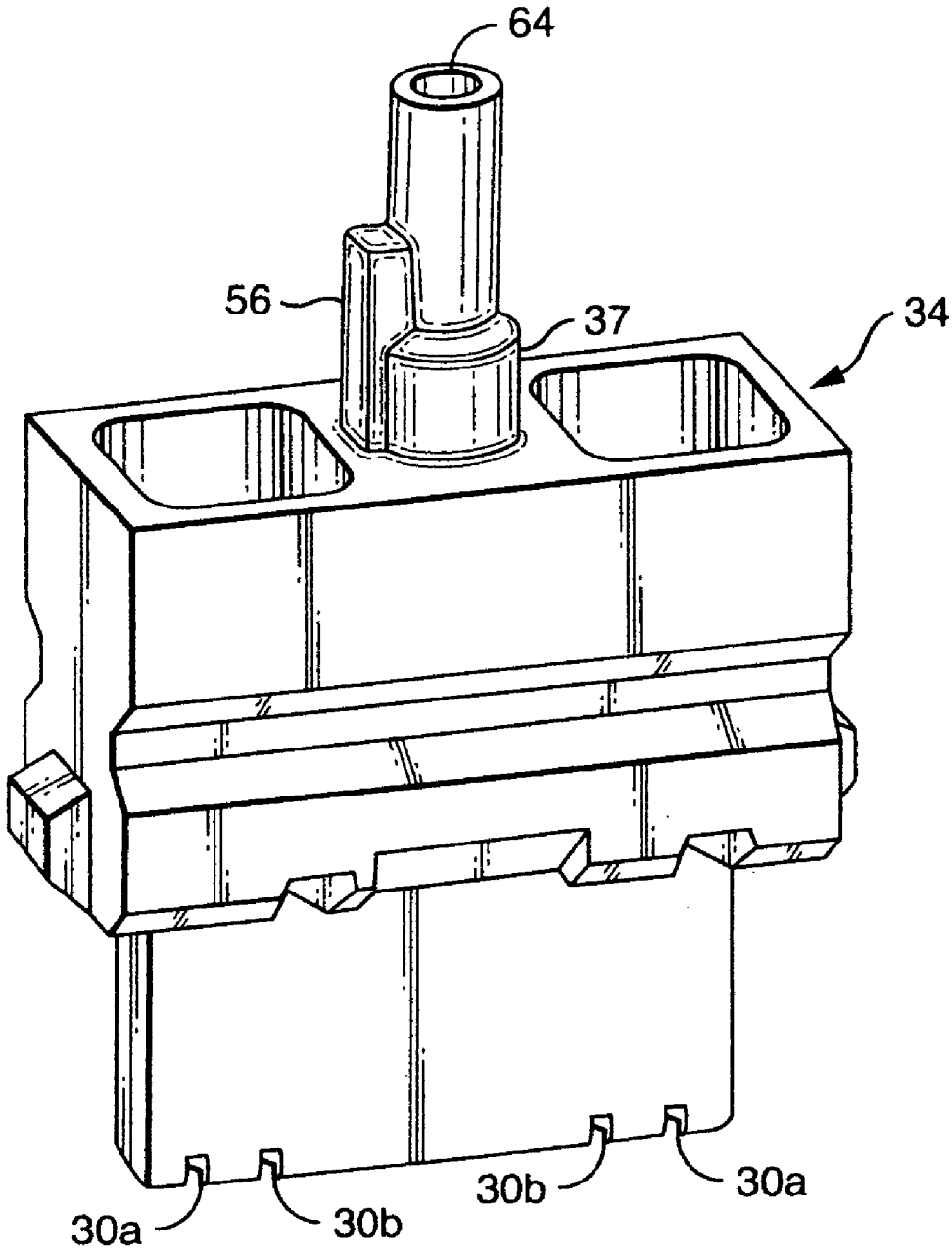
FIG. 3 is a perspective view of the base.
Figure 4:
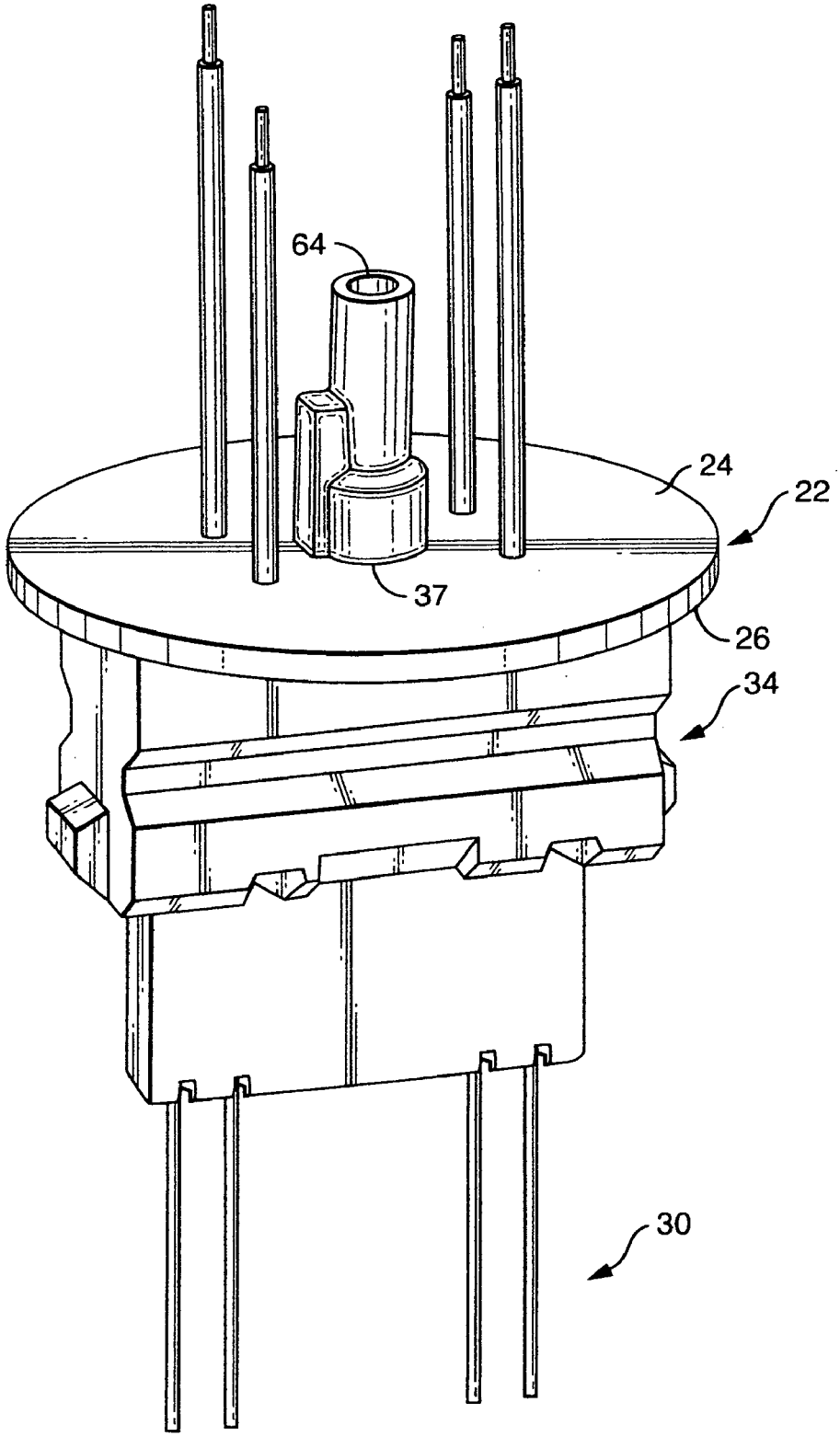
FIG. 4 is a perspective view of the component assembled to the base.

The light source 10 can be assembled by starting with planar member 22 (FIG. 1) and inserting the electrical conductors 30 through the member 22. The base 34 is then attached by fitting the boss 37 into aperture 28 with the conductors 30 that extend from the bottom of member 22 through the apertures 36 in the base 34 (see, FIG. 2) to provide the subassembly shown in FIG. 4.

Figure 5:
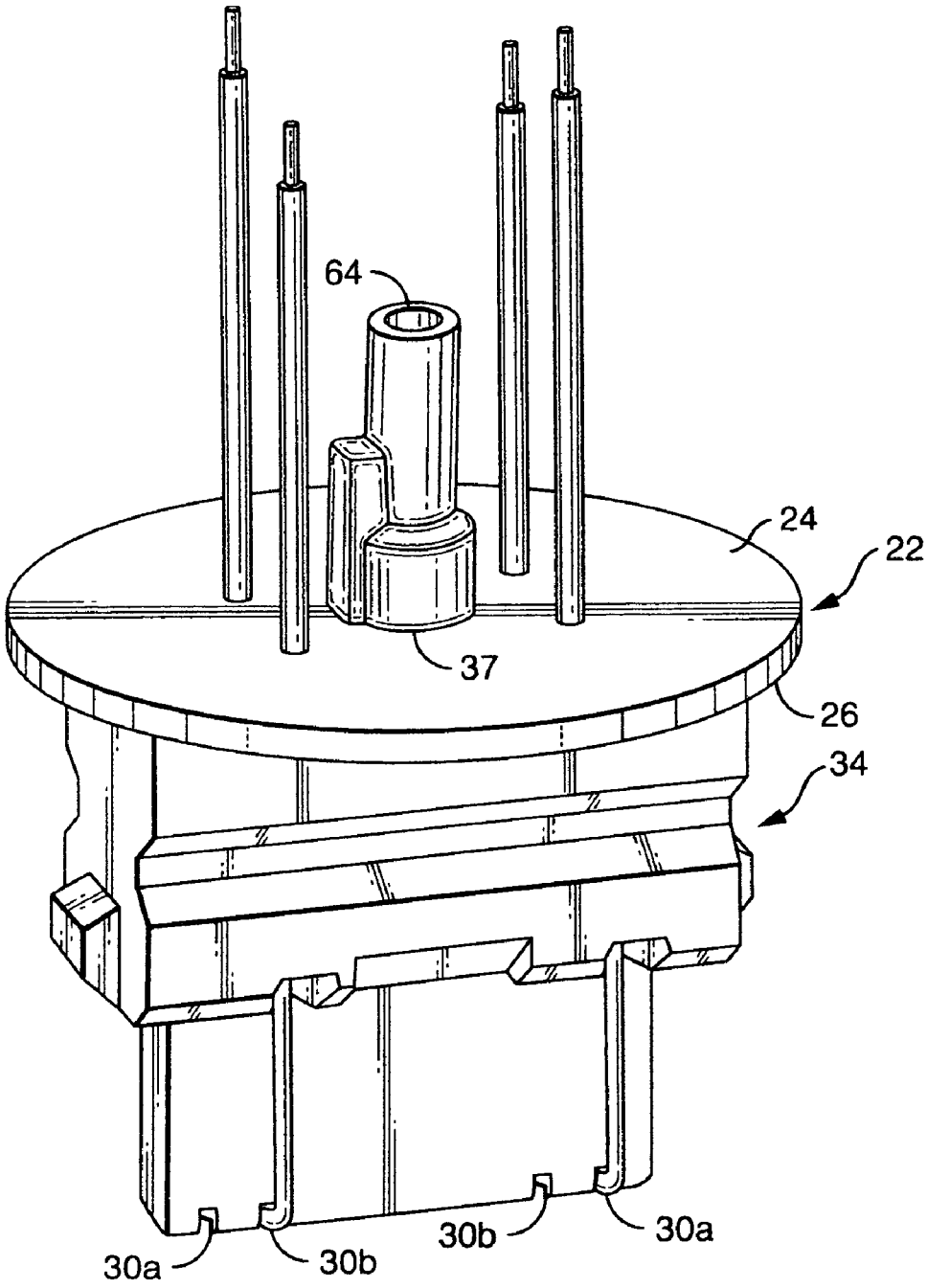
FIG. 5 is a similar view after the contacts in place.

As shown in FIG. 5, the electrical conductors 30 are then bent around the bottom of the base 34 via grooves 34*a* and 34 to provide the electrical contact with the appropriate conductors in the receiving socket.

The spacer 58, which is provided with a keyed central aperture 58*a*, is fitted over the boss 37. As noted above, the spacer 58 is preferably substantially cruciform allowing spaces between the spokes to accommodate the electrical conductors 30.

The body 38 is then fitted over the boss 37 and the summit 60 is attached and the whole assembly is secured by means of bolt 62, which extends centrally through the body 38 and engages a threaded aperture 64 in the boss 37.

The LEDs 52 are attached, as by solder, gluing welding, swedging, press-fitting or any other suitable technique, and the electrical connections are made to electrical connectors 30.

Figure 11:
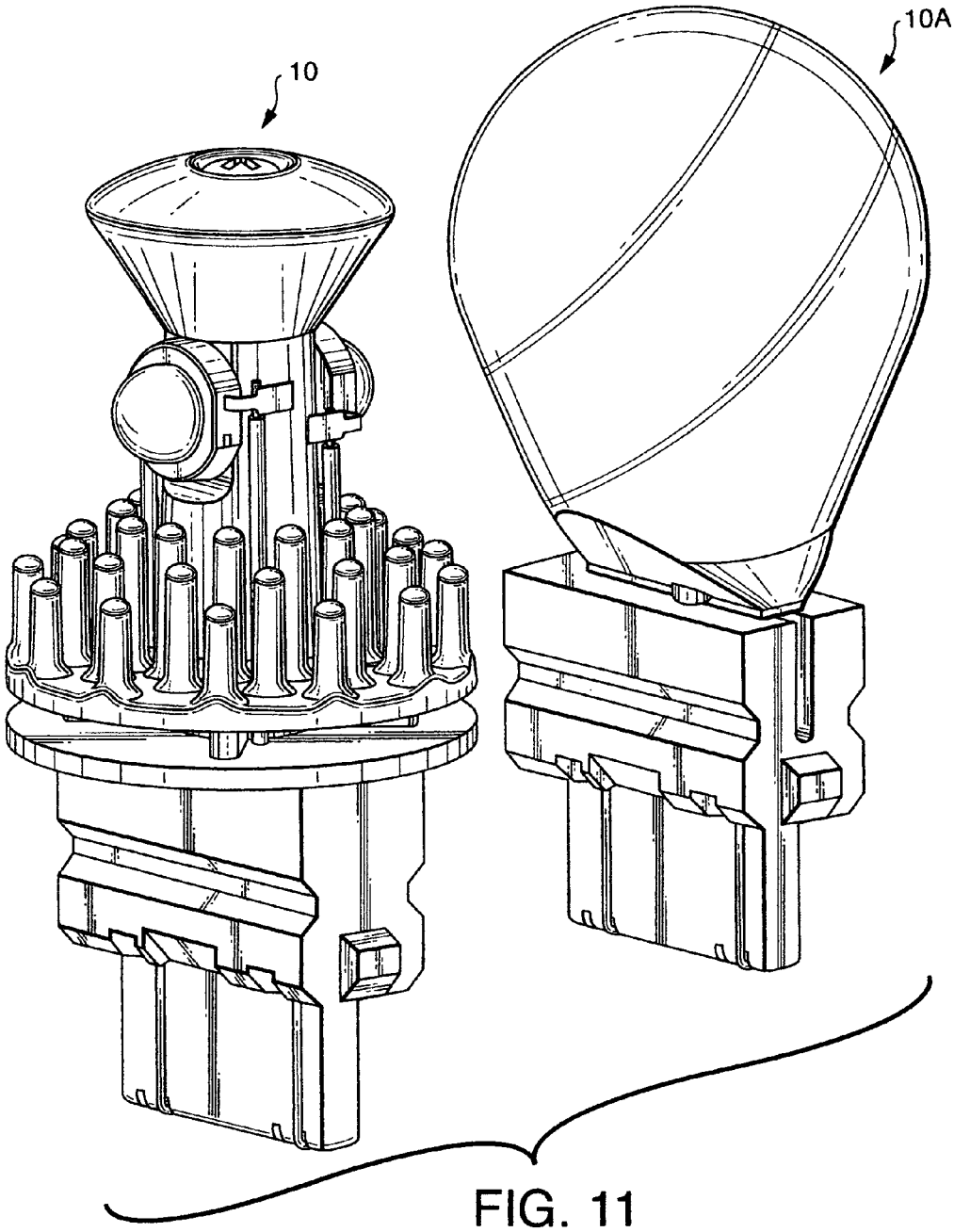
FIG. 11 is comparison of the lamp of the invention with the lamp it replaces.

By referring to FIG. 11 it will be seen that the light source 10 of the invention approximates the volume and height (or length) of the incandescent light source 10*a*, making it a suitable replacement device for the after-market auto industry.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A light source system arranged about an axis, said light source system comprising:

a planar member having a top surface and a bottom surface with a central aperture therethrough and a plurality of electrical conductors spaced about said central aperture and extending beyond said top and bottom surfaces, as least a portion of said electrical conductors extending beyond said top surface having an electrical insulator thereon;

a base having passage therethrough to receive said electrical conductors extending beyond said bottom surface of said planar member and including a boss on a top surface of said base fitted through said central aperture;

a body having a first part coaxial with said axis and a second part transverse to said axis;

at least one light emitting diode positioned near one end of said first part of said body;

said base being positioned at said second part of said body; and a plurality of rod-like members projecting from said second part of said body parallel to said axis.

2. The light source system of claim 1 wherein said central aperture includes a keyway and said boss includes a key compatible with said keyway.

3. The light source of claim 1 wherein a spacer is provided between said second part and said top surface of said planar member whereby an air gap is provided between said body and said planar member.

4. The light source of claim 1 wherein said first part of said body has a summit formed as an inverted cone.

5. The light source of claim 1 wherein at least some of said rod-like members extend for varying lengths away from said second part.

6. The light source of claim 4 wherein the height of said body and said summit above said planar member approximates the height of a dual-filamented bulb normally employed as a turn signal/tail light indicator in a motor vehicle.

7. The light source of claim 1 wherein said rod-like members dissipate heat generated from said at least one light emitting diode when said light emitting diode is operating.

* * * * *